US011621114B2

(12) United States Patent
Kobayashi et al.

(10) Patent No.: US 11,621,114 B2
(45) Date of Patent: Apr. 4, 2023

(54) WIRE-WOUND COIL COMPONENT

(71) Applicant: TAIYO YUDEN CO., LTD., Tokyo (JP)

(72) Inventors: Satoshi Kobayashi, Tokyo (JP); Hidenori Aoki, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 720 days.

(21) Appl. No.: 16/196,702

(22) Filed: Nov. 20, 2018

(65) Prior Publication Data

US 2019/0237236 A1 Aug. 1, 2019

(30) Foreign Application Priority Data

Jan. 26, 2018 (JP) ..... JP2018-011835

(51) Int. Cl.

| | |
|---|---|
| ***H01F 27/255*** | (2006.01) |
| ***H01F 17/04*** | (2006.01) |
| ***H01F 1/14*** | (2006.01) |
| ***H01F 27/28*** | (2006.01) |
| ***H01F 1/26*** | (2006.01) |
| ***H01F 3/08*** | (2006.01) |
| *H01F 27/29* | (2006.01) |
| *H01F 3/10* | (2006.01) |

(52) U.S. Cl.

CPC ..... *H01F 27/255* (2013.01); *H01F 1/14* (2013.01); *H01F 1/26* (2013.01); *H01F 3/08* (2013.01); *H01F 17/045* (2013.01); *H01F 27/2823* (2013.01); *H01F 27/292* (2013.01); *H01F 2003/106* (2013.01); *H01F 2017/048* (2013.01)

(58) Field of Classification Search

CPC .. H01F 27/255; H01F 17/045; H01F 27/2823; H01F 2017/048

USPC ..... 336/221

See application file for complete search history.

(56) References Cited

U.S. PATENT DOCUMENTS 1,060,052 A * 4/1913 Winkler ..... B65D 49/06 215/23

5,382,937 A * 1/1995 Saitoh ..... H01F 29/10 336/134

(Continued)

FOREIGN PATENT DOCUMENTS

CN 103928218 A * 7/2014 ..... H01F 1/14741

JP 2003-068513 A 3/2003

(Continued)

OTHER PUBLICATIONS

Notice of Reasons for Refusal dated Oct. 12, 2021 issued in corresponding Japanese Patent Application No. 2018-011835, with English translation (12 pgs.).

(Continued)

*Primary Examiner* — Elvin G Enad

*Assistant Examiner* — Joselito S. Baisa

(74) *Attorney, Agent, or Firm* — Pillsbury Winthrop Shaw Pittman, LLP

(57) ABSTRACT

A coil component according to one aspect is provided with a core containing a plurality of soft magnetic metal particles, a winding wire wound on the core, and a sheathing body provided on the core so as to cover at least part of the winding wire and having a relative magnetic permeability smaller than that of the core.

14 Claims, 12 Drawing Sheets

(56) References Cited

U.S. PATENT DOCUMENTS

| | | | | |
|---|---|---|---|---|
| 7,183,886 | B2 * | 2/2007 | Ooki | H01F 17/045 336/83 |
| 7,623,014 | B2 * | 11/2009 | Hsieh | H01F 17/045 336/185 |
| 8,643,455 | B2 * | 2/2014 | Ogawa | H01F 27/027 336/83 |
| 8,723,629 | B1 | 5/2014 | Liu et al. | |
| 8,754,739 | B2 * | 6/2014 | Inaba | H01F 37/00 336/212 |
| 9,117,580 | B2 * | 8/2015 | Wu | H01F 27/2823 |
| 9,136,050 | B2 * | 9/2015 | Hsieh | H05K 3/301 |
| 9,147,514 | B2 * | 9/2015 | Nakada | H01F 1/33 |
| 9,208,937 | B2 * | 12/2015 | Wu | H01F 27/255 |
| 9,589,716 | B2 * | 3/2017 | Doljack | H01F 17/04 |
| 9,818,534 | B2 * | 11/2017 | Sakamoto | H01F 27/2828 |
| 10,902,989 | B2 * | 1/2021 | Liu | H01F 27/255 |
| 2006/0071749 | A1 * | 4/2006 | Aoki | H01F 17/045 336/83 |
| 2008/0055034 | A1 * | 3/2008 | Tsunemi | H01F 3/10 336/83 |
| 2009/2012894 | | 8/2009 | Hsieh et al. | |
| 2009/0231077 | A1 * | 9/2009 | Liao | H01F 17/04 336/177 |
| 2013/0194060 | A1 | 8/2013 | Nakada et al. | |
| 2015/0310975 | A1 * | 10/2015 | Wu | H01F 17/045 336/83 |
| 2016/0027574 | A1 * | 1/2016 | Aoki | H01F 17/045 336/192 |
| 2016/0141087 | A1 * | 5/2016 | Liu | H01F 1/14766 336/83 |
| 2017/0263373 | A1 | 9/2017 | Ashizawa et al. | |
| 2019/0392978 | A1 * | 12/2019 | Matsuura | H01F 1/26 |
| 2021/0193362 | A1 * | 6/2021 | Tsuchiya | H01F 1/26 |

FOREIGN PATENT DOCUMENTS

| | | | |
|---|---|---|---|
| JP | 2006-156694 A | | 6/2006 |
| JP | 2006253394 A | * | 9/2006 |
| JP | 2008195970 A | * | 8/2008 |
| JP | 2009-200456 A | | 9/2009 |
| JP | 2013-55078 A | | 3/2013 |
| JP | 2017-163099 A | | 9/2017 |

OTHER PUBLICATIONS

Notice of Reasons for Refusal dated Apr. 12, 2022, issued in corresponding Japanese Patent Application No. 2018-011835 with English translation (9 pgs.).

* cited by examiner

WIRE-WOUND COIL COMPONENT

CROSS-REFERENCE TO RELATED APPLICATIONS

This application is based on and claims the benefit of priority from Japanese Patent Application Serial No. 2018-011835 (filed on Jan. 26, 2018), the contents of which are hereby incorporated by reference in their entirety.

TECHNICAL FIELD

The present invention relates to a wire-wound coil component.

BACKGROUND

Various coil components are used in electronic devices. Examples of coil components include an inductor and a transformer used to eliminate noise from signals.

A wire-wound coil component is known as such a coil component. The wire-wound coil component is provided with a core having a winding core, a winding wire wound around the winding core, and a plurality of terminal electrodes electrically connected respectively to end portions of the winding wire. This conventional coil component is produced by first molding the core and winding the winding wire on the core thus molded.

There is also known a coil component having a sheathing body covering a winding wire. Typically, the sheathing body is made of a thermosetting resin such as an epoxy resin and provided between flanges of a core. For the purpose of improving a magnetic permeability, magnetic particles formed of a magnetic material may be mixed into the sheathing body. Such a coil component provided with a sheathing body containing magnetic particles is disclosed in, for example, the specification of U.S. Pat. No. 9,117,580. The sheathing body is formed as a member separate from a core and mounted to the core after a winding wire is wound on the core.

An integrally molded coil component is also known as another type of conventional coil component. The integrally molded coil component is obtained by pressure-molding a composite resin material containing magnetic particles together with a winding wire. In the integrally molded coil component, the winding wire is embedded in an integrally molded magnetic body. The integrally molded coil component thus described is referred to also as a metal composite coil component. Such a conventional integrally molded coil component (a metal composite coil component) is described in, for example, Japanese Patent Application Publication No. 2003-068513.

As described in Japanese Patent Application Publication No. 2013-055078, the integrally molded coil component has excellent inductor characteristics as a power inductor.

In molding the integrally molded coil component, a high molding pressure cannot be used since the winding wire would also be subjected to the molding pressure. Because of this, in the integrally molded coil component, a limitation is imposed on a filling factor of magnetic particles, thus making it difficult to obtain a high inductance. Furthermore, in the integrally molded coil component, the winding wire may get damaged due to a pressure applied thereto at the time of molding.

In the coil component having the sheathing body separate from the core, unlike in the integrally molded coil component, the above-described limitation is not imposed. That is, in the coil component having the sheathing body separate from the core, the winding wire is wound on the core molded, and then the sheathing body is mounted so as to cover the winding wire, and thus the winding wire imposes no limitation on a pressure used at the time of molding the core. It is, therefore, desirable that, by use of the coil component having the sheathing body separate from the core, inductor characteristics superior to those of the integrally molded coil component be achieved.

SUMMARY

One object of the present disclosure is to achieve, in the coil component having the sheathing body separate from the core, inductor characteristics superior to those of the integrally molded coil component. Other objects of the present disclosure will be made apparent through the entire description herein.

A coil component according to one aspect of the present disclosure is provided with a core containing a plurality of soft magnetic metal particles, a winding wire wound on the core, and a sheathing body provided on the core so as to cover at least part of the winding wire and having a relative magnetic permeability smaller than that of the core. In one aspect, the sheathing body has a relative magnetic permeability of 25 or more.

In the coil component according to one aspect of the present disclosure, the core has a relative magnetic permeability of 30 or more.

In the coil component according to one aspect of the present disclosure, the core has a relative magnetic permeability of 60 or less.

In the coil component according to one aspect of the present disclosure, the sheathing body has a relative magnetic permeability of 50 or less.

In the coil component according to one aspect of the present disclosure, the core contains a conjugate composed of adjacent ones of the plurality of soft magnetic metal particles, the adjacent ones being conjugated to each other.

In the coil component according to one aspect of the present disclosure, the core contains a resin, and the plurality of soft magnetic metal particles are contained in the resin.

In the coil component according to one aspect of the present disclosure, a content of the plurality of soft magnetic metal particles in the core is 50 wt % to 95 wt %.

In the coil component according to one aspect of the present disclosure, the plurality of soft magnetic metal particles include Fe particles, and a content of the Fe particles in the core is 50 wt % to 95 wt %.

In the coil component according to one aspect of the present disclosure, the plurality of soft magnetic metal particles include Fe particles, and a content of the Fe particles in the core is 55 wt % to 85 wt %.

In the coil component according to one aspect of the present disclosure, the sheathing body is made of a composite resin material containing a plurality of magnetic particles.

Advantages

According to the coil component of the present disclosure, by use of the coil component having the sheathing body separate from the core, inductor characteristics superior to those of the integrally molded coil component can be achieved.

DESCRIPTION OF THE PREFERRED EMBODIMENTS

By appropriately referring to the appended drawings, the following describes various embodiments of the technique disclosed herein. Constituent elements common to a plurality of drawings are denoted by the same reference signs throughout the plurality of drawings. It should be noted that the drawings do not necessarily appear to an accurate scale for the sake of convenience of explanation.

Figure 1:
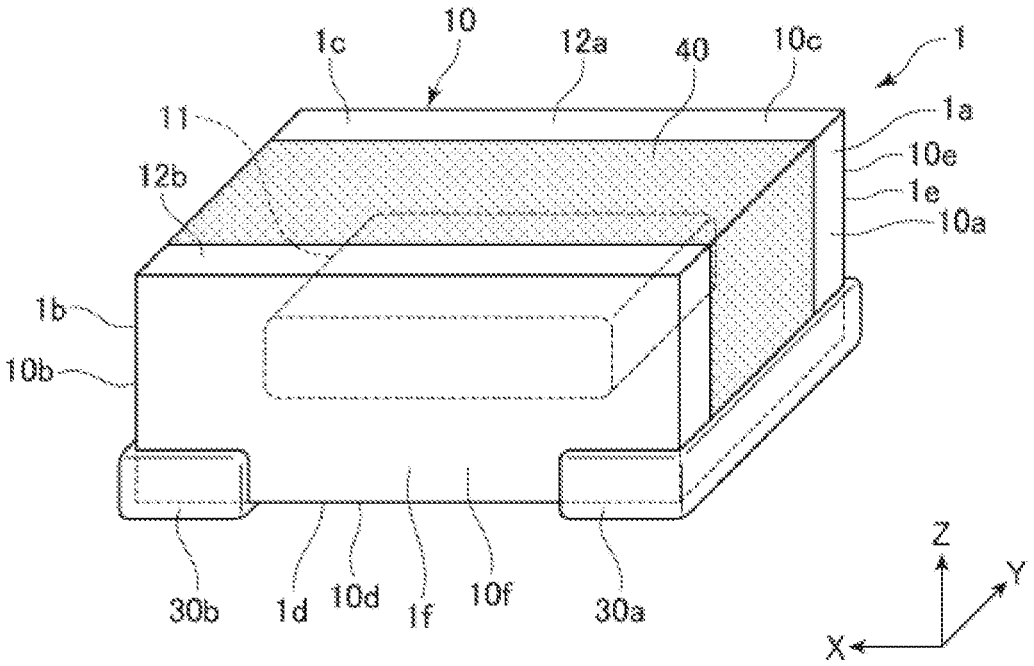
FIG. 1 is a perspective view showing a coil component according to one embodiment.
Figure 2:
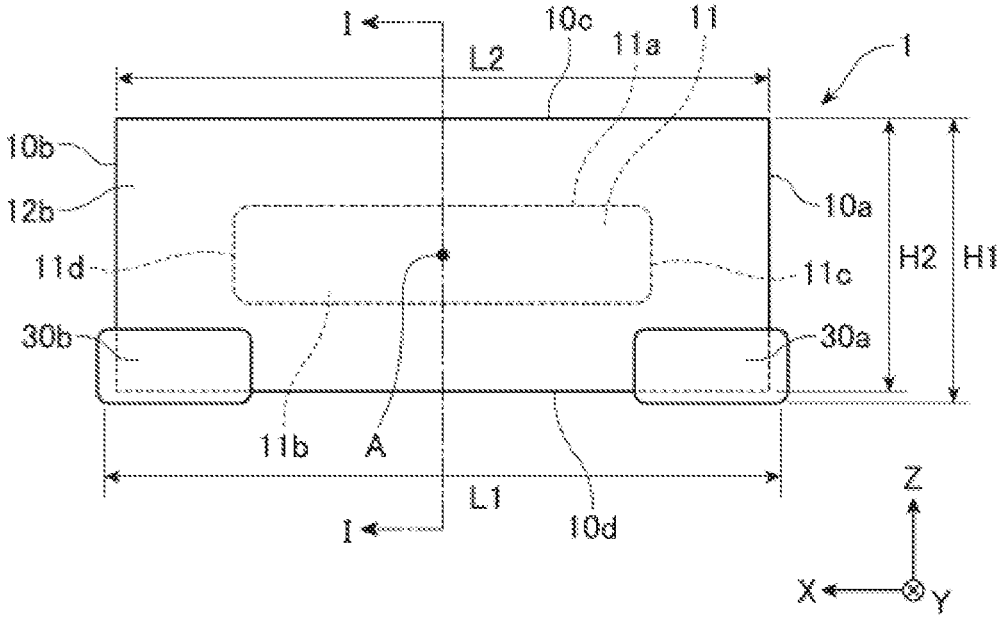
FIG. 2 is a front view of the coil component shown in FIG. 1.
Figure 3:
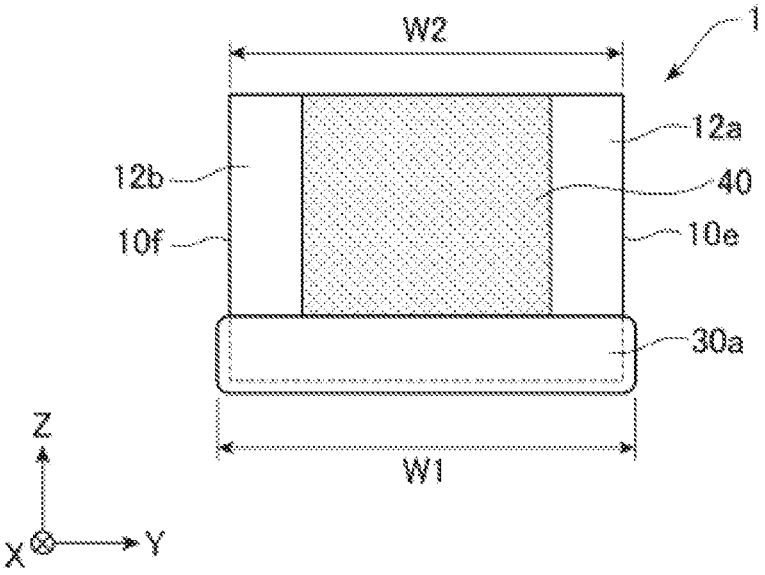
FIG. 3 is a right side view of the coil component shown in FIG. 1.
Figure 4:
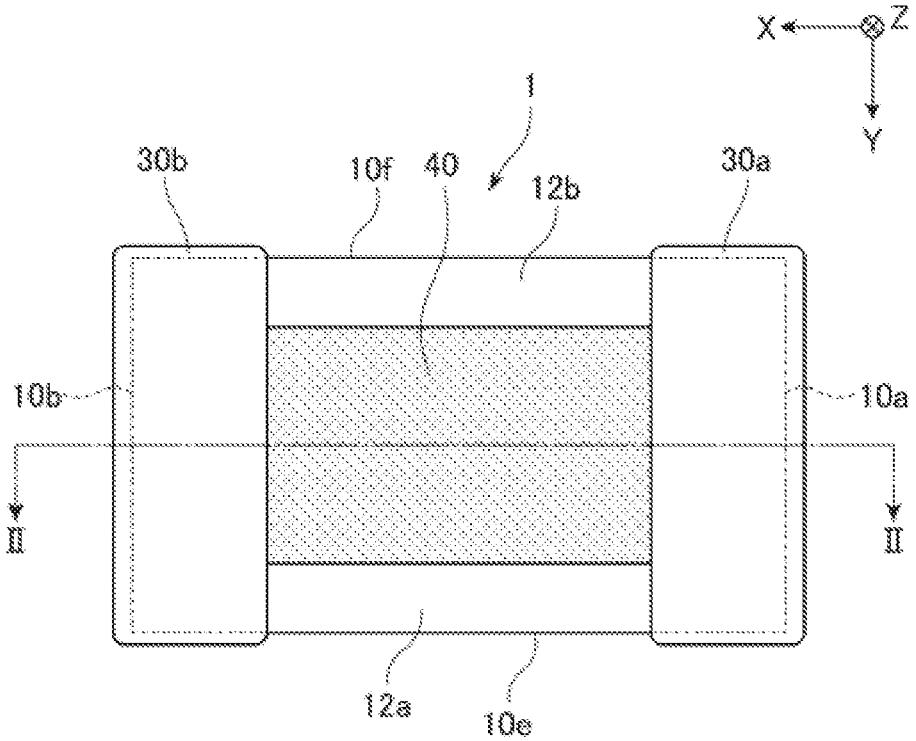
FIG. 4 is a bottom view of the coil component shown in FIG. 1.
Figure 5:
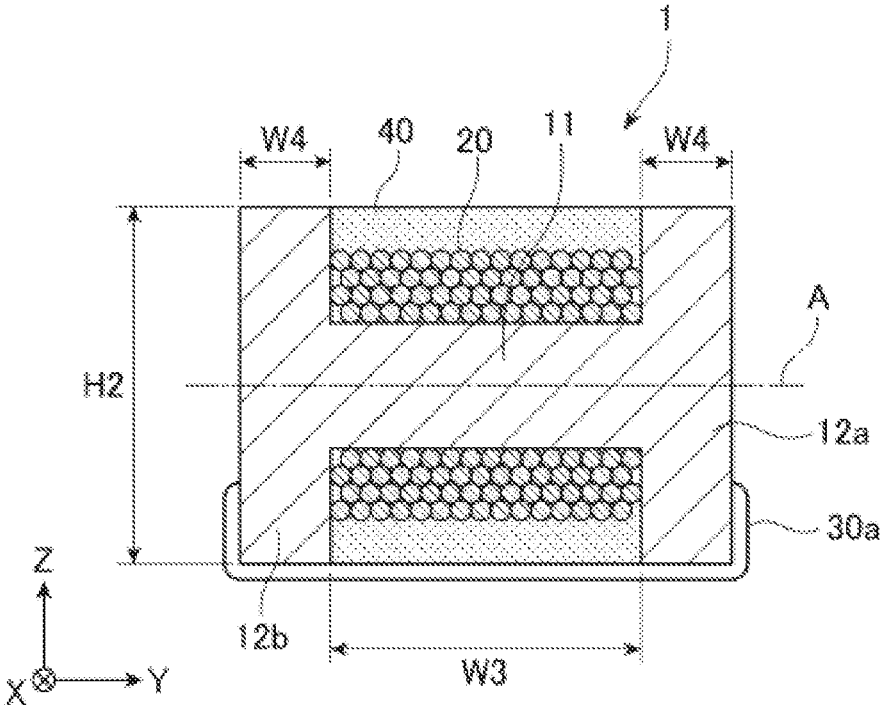
FIG. 5 is a sectional view of the coil component shown in FIG. 2 cut along a plane passing through a line I-I.
Figure 6:
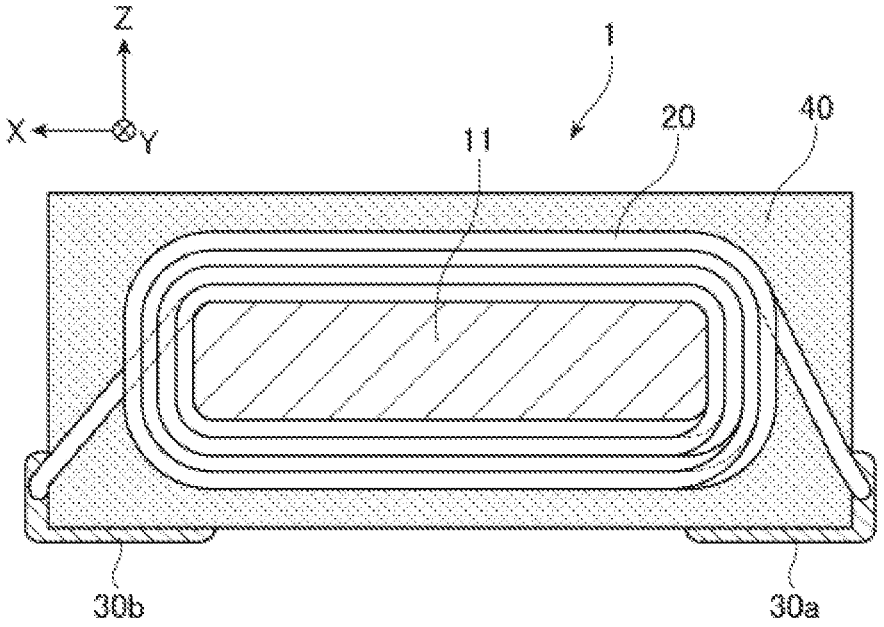
FIG. 6 is a sectional view of the coil component shown in FIG. 4 cut along a plane passing through a line II-II.

With reference to FIG. 1 to FIG. 6, a description is given of a coil component according to one embodiment. FIG. 1 is a perspective view showing a coil component 1 according to one embodiment, FIG. 2 is a front view thereof, FIG. 3 is a right side view thereof, and FIG. 4 is a bottom view thereof. FIG. 5 is a sectional view of the coil component 1 cut along a plane passing through a line I-I in FIG. 2, and FIG. 6 is a sectional view of the coil component 1 cut along a plane passing through a line II-II in FIG. 4.

The coil component 1 is, for example, an inductor used to eliminate noise in an electronic circuit. The coil component 1 may be a power inductor built in a power supply line or an inductor used in a signal line.

FIG. 1 shows an X direction, a Y direction, and a Z direction orthogonal to one another. Herein, orientations and arrangements of constituent members of the coil component 1 may be described based on the X direction, the Y direction, and the Z direction shown in FIG. 1. Specifically, an extending direction of an axis A of a winding core 11 is defined as the Y direction, and a direction perpendicular to the axis A of the winding core 11 and parallel to a mounting surface of a circuit board is defined as the X direction. Furthermore, a direction orthogonal to the X direction and the Y direction is defined as the Z direction. Herein, the X direction may be referred to as a length direction of the coil component 1, the Y direction may be referred to as a width direction of the coil component 1, and the Z direction may be referred to as a height direction of the coil component 1.

As shown, the coil component 1 according to one embodiment is formed in a rectangular parallelepiped shape. The coil component 1 has a first end surface 1*a*, a second end surface 1*b*, a first principal surface 1*c* (a top surface 1*c*), a second principal surface 1*d* (a bottom surface 1*d*), a first side surface 1*e*, and a second side surface if. More specifically, the first end surface 1*a* is an end surface of the coil component 1 in an X-axis negative direction, the second end surface 1*b* is an end surface of the coil component 1 in an X-axis positive direction, the first principal surface 1*c* is an end surface of the coil component 1 in a Z-axis positive direction, the second principal surface 1*d* is an end surface of the coil component 1 in a Z-axis negative direction, the first side surface 1*e* is an end surface of the coil component 1 in a Y-axis positive direction, and the second side surface if is an end surface of the coil component 1 in a Y-axis negative direction.

Each of the first end surface 1*a*, the second end surface 1*b*, the first principal surface 1*c*, the second principal surface 1*d*, the first side surface 1*e*, and the second side surface if of the coil component 1 may be a flat surface or a curved surface. Furthermore, eight corners of the coil component 1 may be rounded. As thus described, herein, even in a case where some of the first end surface 1*a*, the second end surface 1*b*, the first principal surface 1*c*, the second principal surface 1*d*, the first side surface 1*e*, and the second side surface if of the coil component 1 are curved or in a case where the corners of the coil component 1 are rounded, such a shape of the coil component 1 may be referred to as a "rectangular parallelepiped shape." That is, a "rectangular parallelepiped" or a "rectangular parallelepiped shape" described herein is not intended to mean a "rectangular parallelepiped" in a mathematically strict sense.

As shown, the coil component 1 is provided with a core 10 of a drum core type, a winding wire 20, a first external electrode 30*a*, a second external electrode 30*b*, and a sheathing body 40.

The core 10 has a winding core 11 extending in a direction parallel to the mounting surface of the circuit board, a rectangular parallelepiped-shaped flange 12*a* provided at one end portion of the winding core 11, and a rectangular parallelepiped-shaped flange 12*b* provided at the other end portion of the winding core 11. Accordingly, the winding core 11 couples the flange 12*a* to the flange 12*b*. The flange 12*a* and the flange 12*b* are disposed so that their respective inner surfaces are opposed to each other. Each of the inner surface, an outer surface, and four surfaces connecting the inner surface to the outer surface of each of the flange 12*a* and the flange 12*b* may be a flat surface or a curved surface. Furthermore, eight corners of each of the flange 12*a* and the flange 12*b* may be rounded. As thus described, herein, even in a case where the flange 12*a* and the flange 12*b* have a curved surface or in a case where the corners of each of the flange 12*a* and flange 12*b* are rounded, such a shape may be referred to as a "rectangular parallelepiped shape."

Each of the outer surface of the flange 12*a* disposed so as to be opposed to the inner surface thereof and the outer surface of the flange 12*b* disposed so as to be opposed to the inner surface thereof constitutes part of outer surfaces of the coil component 1. The flange 12*a* and the flange 12*b* may be partly or entirely covered by the after-mentioned sheathing body 40. In this case, outer surfaces of the sheathing body 40 constitute part of the outer surfaces of the coil component 1.

The flange 12*a* and the flange 12*b* are configured so that their inner surfaces and outer surfaces extend in a direction perpendicular to the axis A of the winding core 11. The terms "perpendicular," "orthogonal," and "parallel" used herein are not used in a mathematical strict sense. For example, in a case where the inner surface of the flange 12*a* extends in the direction perpendicular to the axis A of the winding core 11, an angle formed by the outer surface of the flange 12*a* and the axis A of the winding core 11 may be 90° but is only required to be substantially 90°. An angle range of substantially 90° can include any angle value within a range of 70° to 110°, 75° to 105°, 80° to 100°, or 85° to 95°. As well as the terms "parallel" and "orthogonal," other terms included herein, which are interpretable in a mathematically strict sense, can be interpreted more broadly than the mathematically strict sense in view of the purport and context of the present invention and the technical common knowledge.

The flange 12*a* and the flange 12*b* are not limited in terms of a shape applicable to the present invention to a rectangular parallelepiped shape and can be formed in various shapes. In one embodiment, one or both of the flange 12*a* and the flange 12*b* may have one or a plurality of cutouts formed at any corner or side thereof. After-mentioned end portions 20*a* and 20*b* of the winding wire 20 can be bonded to the cutouts by thermal compression.

The core 10 has a first end surface 10*a*, a second end surface 10*b*, a first principal surface 10*c* (a top surface 10*c*), a second principal surface 10*d* (a bottom surface 10*d*), a first side surface 10*e*, and a second side surface 10*f*. More specifically, the first end surface 10*a* is an end surface of the core 10 in the X-axis negative direction, the second end surface 10*b* is an end surface of the core 10 in the X-axis positive direction, the first principal surface 10*c* is an end surface of the core 10 in the Z-axis positive direction, the second principal surface 10*d* is an end surface of the core 10 in the Z-axis negative direction, the first side surface 10*e* is an end surface of the core 10 in the Y-axis positive direction, and the second side surface 10*f* is an end surface of the core 10 in the Y-axis negative direction. The first end surface 10*a*, the second end surface 10*b*, the first principal surface 10*c*, the second principal surface 10*d*, the first side surface 10*e*, and the second side surface 10*f* constitute part of the first end surface 1*a*, the second end surface 1*b*, the first principal surface 1*c*, the second principal surface 1*d*, the first side surface 1*e*, and the second side surface if of the coil component 1, respectively.

In the embodiment shown, the winding core 11 is in a substantially quadrangular prism shape. The winding core 11 can assume any shape suitable for winding the winding wire 20 thereon. For example, the winding core 11 can assume a polygonal prism shape such as a triangular prism shape, a pentagonal prism shape, or a hexagonal prism shape, a columnar shape, an elliptical columnar shape, or a truncated cone shape.

The core 10 contains a plurality of soft magnetic metal particles. In one embodiment, the core 10 is a pressed powder core. In a case where the core 10 is a pressed powder core, a conjugate composed of soft magnetic metal particles conjugated to each other is contained in the core 10. In the case where the core 10 is a pressed powder core, the core 10 is produced by mixing soft magnetic metal particles having a predetermined composition with a binder to form a granulated substance, press-molding the granulated substance by use of a molding die into a pressed powder body, and sintering the pressed powder body. In the case where the core 10 is a pressed powder core, at the time of sintering, an oxidized layer is formed on a surface of each of the soft magnetic metal particles, and adjacent ones of the soft magnetic metal particles are conjugated to each other via the oxidized layer. That is, in the case where the core 10 is a pressed powder core, the core 10 contains a conjugate composed of adjacent ones of the soft magnetic metal particles, the adjacent ones being conjugated to each other.

In another embodiment, the core 10 is a resin-cured core. The resin-cured core 10 contains a cured resin and a plurality of soft magnetic metal particles dispersed in the resin. Specifically, the resin-cured core 10 is produced by mixing soft magnetic metal particles with a thermosetting resin to form a mixture and thermally curing the mixture in a molding die. As the thermosetting resin, an epoxy resin, a silicone resin, a phenol resin, a polyimide resin, a polyurethane resin, or any other thermosetting resin can be used. To produce the resin-cured core 10, it is also possible to use, in place of the thermosetting resin, a photo-curable resin, glass, or an insulating oxide (for example, Ni—Zn ferrite or silica).

The soft magnetic metal particles contained in the core 10 are, for example, particles of (1) a metal such as Fe or Ni, (2) a crystalline alloy such as an Fe—Si—Cr alloy, an Fe—Si—Al alloy, or an Fe—Ni alloy, (3) an amorphous alloy such as an Fe—Si—Cr—B—C alloy or an Fe—Si—B—Cr alloy, or a mixture thereof. The soft magnetic metal particles contained in the core 10 are not limited in composition to the above-described substances. For example, the soft magnetic metal particles contained in the core 10 may be particles of a Co—Nb—Zr alloy, an Fe—Zr—Cu—B alloy, an Fe—Si—B alloy, an Fe—Co—Zr—Cu—B alloy, an Ni—Si—B alloy, or an Fe—Al—Cr alloy.

The soft magnetic metal particles contained in the core 10 can be manufactured by an atomizing method or any other known method. Commercially available soft magnetic metal particles can also be used as the soft magnetic metal particles contained in the core 10. Examples of commercially available metal magnetic particles include PF-20F manufactured by Epson Atmix Corporation and SFR-FeSiAl manufactured by Nippon Atomized Metal Powders Corporation.

An average particle size of the soft magnetic metal particles contained in the core 10 is set to, for example, 1 μm to 50 μm.

In one embodiment, the core 10 has a relative magnetic permeability of 30 or more. It is known that when the relative magnetic permeability of the core 10 becomes larger than 60, an insulation resistance of the core 10 abruptly decreases. This is because of the following reason: while increasing the relative magnetic permeability of the core 10 requires to increase a filling factor of the soft magnetic metal particles in the core 10, increasing the filling factor of the soft magnetic metal particles in the core 10 results in a decrease in thickness of an insulation resistance layer present between the soft magnetic metal particles, leading to an abrupt decrease in insulation resistance of the core 10. For this reason, in one embodiment, the core 10 is set to have a relative magnetic permeability of 60 or less. The core 10 may be configured so that the relative magnetic permeability thereof has any value within a range of 30 to 60.

The relative magnetic permeability of the core 10 can be adjusted through a composition of the soft magnetic metal particles contained in the core 10, a content ratio (the filling factor) of the soft magnetic metal particles in the core 10, and other factors. For example, the relative magnetic permeability of the core 10 can be increased by using soft magnetic metal particles formed of an alloy of a composition having a high iron content ratio or pure iron. Furthermore, the relative magnetic permeability of the core 10 can be increased by increasing the filling factor of the soft magnetic metal particles in the core 10.

In one embodiment, a content of the soft magnetic metal particles with respect to the core 10 as a whole is 50 wt % to 99 wt %. In one embodiment, the content of the soft magnetic metal particles with respect to the core 10 as a whole is 95 wt % to 99 wt %.

In one embodiment, the core 10 is configured so that pure iron particles (Fe particles) are contained as the soft magnetic metal particles and a content of the Fe particles is 50 wt % to 95 wt %. In one embodiment, the content of the Fe particles with respect to the core 10 as a whole is 98 wt % to 99 wt %.

The winding wire 20 is wound on the wiring core 11. The winding wire 20 is formed by applying an insulation coating around a conductor wire made of a metal material having excellent electrical conductivity. As the metal material used for the winding wire 20, there can be used, for example, one or more from among Cu (copper), Al (aluminum), Ni (nickel), and Ag (silver) or an alloy containing any of these metals.

In at least one of the flange 12*a* and the flange 12*b*, external electrodes are provided respectively at both end portions thereof in an X-axis direction. The external electrodes may be provided in both of the flange 12*a* and the flange 12*b* or only in one of them (only in the flange 12*a* or only in the flange 12*b*). FIG. 1 shows an example in which the external electrodes are provided in both of the flange 12*a* and the flange 12*b*.

In one embodiment of the present invention, an external electrode 30*a* is configured to cover an end portion of the bottom surface 10*d* of the core 10 in the X-axis negative direction, a region of the end surface 10*a*, the region extending up to a predetermined height, and respective regions of the side surface 10*e* and the side surface 10*f* in the X-axis negative direction, the regions extending up to a predetermined height. Similarly, an external electrode 30*b* is configured to cover an end portion of the bottom surface 10*d* of the core 10 in the X-axis positive direction, a region of the end surface 10*b*, the region extending up to a predetermined height, and respective regions of the side surface 10*e* and the side surface 10*f* in the X-axis positive direction, the regions extending up to a predetermined height.

The shape and arrangement of the external electrode 30*a* and the external electrode 30*b* shown are merely illustrative, and the external electrode 30*a* and the external electrode 30*b* can be variously shaped and arranged. The coil component 1 may be provided as appropriate with a dummy electrode in addition to the external electrode 30*a* and the external electrode 30*b*.

In one embodiment of the present invention, the external electrode 30*a* and the external electrode 30*b* each have a base electrode and a plating layer covering the base electrode. The base electrode is formed by, for example, applying a paste-like electrically conductive material (for example, silver) to the surfaces of the core 10 by dipping (immersion) and drying the electrically conductive material thus applied. The plating layer formed on the base electrode is composed of two layers that are, for example, a nickel plating layer and a tin plating layer formed on the nickel plating layer. The external electrode 30*a* and the external electrode 30*b* may be formed by sputtering or evaporation.

One end portion of the winding wire 20 is electrically connected to the external electrode 30*a*, while the other end portion of the winding wire 20 is electrically connected to the external electrode 30*b*.

The sheathing body 40 contains a resin and a plurality of magnetic particles. The resin contained in the sheathing body 40 is a thermosetting resin having an excellent insulation property, and examples thereof include an epoxy resin, a polyimide resin, a polystyrene (PS) resin, a high-density polyethylene (HDPE) resin, a polyoxymethylene (POM) resin, a polycarbonate (PC) resin, a polyvinylidene fluoride (PVDF) resin, a phenolic resin, a polytetrafluoroethylene (PTFE) resin, a polybenzoxazole (PBO) resin, or any other known resin material used to cover a winding wire in a wire-wound coil component.

In one embodiment of the present invention, the sheathing body 40 is formed by winding a resin sheet containing the plurality of magnetic particles on the winding core 11. The sheathing body 40 is provided so as to cover at least part of the winding wire 20. In one embodiment, the sheathing body 40 is provided so as to entirely cover the winding wire 20 except for end portions thereof. For example, the sheathing body 40 is provided so as to entirely cover a portion of the winding wire 20 extending between the inner surface of the flange 12*a* and the inner surface of the flange 12*b*. As thus described, between the flange 12*a* and the flange 12*b*, the sheathing body 40 is provided around the winding core 11 so as to cover at least part of the winding wire 20.

The magnetic particles contained in the sheathing body 40 include, for example, metal magnetic particles and amorphous alloy particles. In addition to the particles formed of the above-described materials, particles of an inorganic material such as $SiO_2$ or $Al_2O_3$ or glass-based particles can also be contained as part of the plurality of magnetic particles. The magnetic particles contained in the sheathing body 40 may be formed of a soft magnetic alloy material having the same composition as that of soft magnetic alloy particles contained in the core 10.

The sheathing body 40 is formed of a member (an after-mentioned resin sheet) prepared as a member separate from the core 10. The sheathing body 40 is configured to have a relative magnetic permeability smaller than that of the core 10. In one embodiment, the sheathing body 40 has a relative magnetic permeability of 25 or more. In one embodiment, the sheathing body 40 has a relative magnetic permeability of 50 or less. The sheathing body 40 may be configured so that the relative magnetic permeability thereof has any value within a range of 25 to 50. The relative magnetic permeability of the sheathing body 40 can be adjusted through selection of a material of the magnetic particles, a content ratio of the magnetic particles, and other factors. For example, the relative magnetic permeability of the sheathing body 40 can be increased by using magnetic particles formed of an alloy having a high iron content ratio or pure iron. Furthermore, the relative magnetic permeability of the sheathing body 40 can be increased by increasing a filling factor of the magnetic particles in the sheathing body 40.

A description is given of examples of dimensions of the coil component 1 and constituent elements thereof. The coil component 1 is formed so as to have, for example, a length (a dimension in the X direction) L1 of 1 to 2.6 mm, a width (a dimension in the Y direction) W1 of 0.5 to 2.1 mm, and a height (a dimension in the Z direction) H1 of 0.3 to 1.05 mm.

Figure 11:
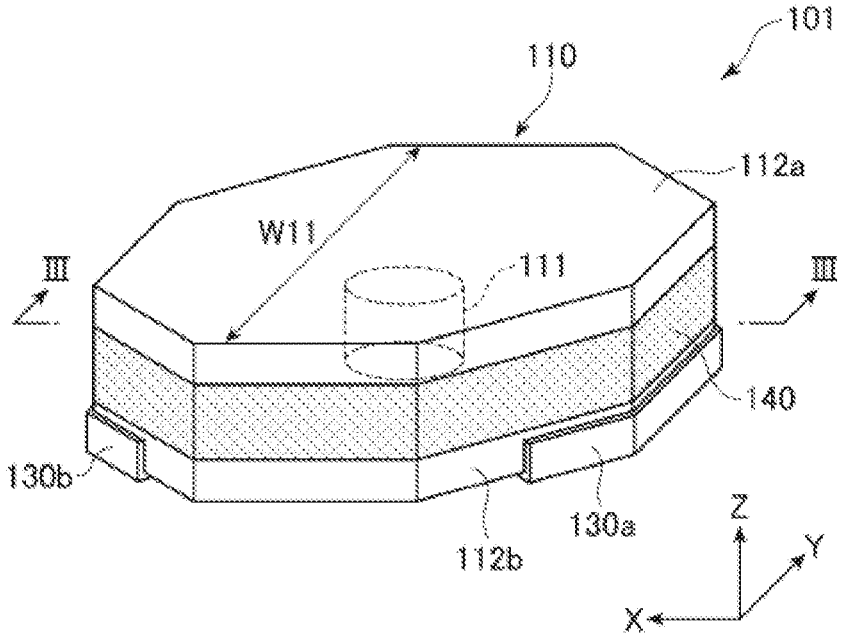
FIG. 11 is a perspective view showing a coil component according to another embodiment.
Figure 12:
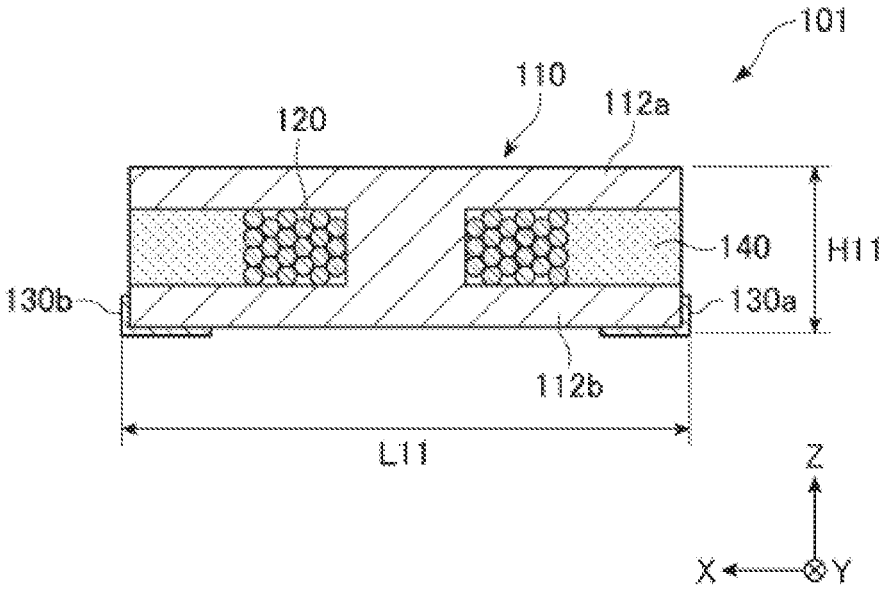
FIG. 12 is a sectional view of the coil component shown in FIG. 11 cut along a plane passing through a line III-III.

The coil component 1 can be variously shaped, dimensioned, and arranged. Next, with reference to FIG. 11 and FIG. 12, a description is given of a coil component according to another embodiment of the present invention. FIG. 11 is a perspective view of a coil component 101 according to another embodiment, and FIG. 12 is a sectional view of the coil component 101 cut along a plane passing through a line III-III in FIG. 11. As shown, the coil component 101 is provided with a core 110 of a drum core type, a winding wire 120, a first external electrode 130*a*, a second external electrode 130*b*, and a sheathing body 140. The core 110 has a winding core 111 extending in a direction perpendicular to a mounting surface of a circuit board, a plate-shaped flange 112*a* provided at one end portion of the winding core 111, and a plate-shaped flange 112*b* provided at the other end portion of the winding core 111. Each of the flange 112*a* and the flange 112*b* is formed in an octagonal shape in plan view. In the coil component 101, the winding core 111 extends in the direction perpendicular to the mounting surface of the circuit board, and this differentiates the coil component 101 from the coil component 1 in which the winding core 11 extends in the direction parallel to the mounting surface of the circuit board. In the coil component 1, the winding core 11 extends in the direction parallel to the mounting surface of the circuit board, and thus the coil component 1 may be referred to as a transversely mounted coil component. In the coil component 101, the winding core 111 extends in the direction perpendicular to the mounting surface of the circuit board, and thus the coil component 101 may be referred to as a longitudinally mounted coil component. Materials and methods used to form the core 110, the winding wire 120, the first external electrode 130*a*, the second external electrode 130*b*, and the sheathing body 140 are the same as or similar to the corresponding materials and methods used to form the core 10, the winding wire 20, the first external electrode 30*a*, the second external electrode 30*b*, and the sheathing body 40 of the coil component 1, respectively. In one embodiment, the coil component 101 is configured to have a dimension in a length direction (a dimension in the X-axis direction) L11 of 1.0 to 2.6 mm, a dimension in a width direction (a dimension in a Y-axis direction) W11 of 1.0 to 2.6 mm, and a dimension in a height direction (a dimension in a Z-axis direction) H11 of 0.5 to 0.8 mm. By adopting these dimensions, the winding core 111 can be reduced in length. The winding core 111 is reduced in length, and thus a magnetic path of a magnetic flux generated from the winding wire 120 can be shortened, so that a compact and high-inductance component can be obtained. These dimensions are mere examples, and a coil component to which the present invention is applicable can have any dimensions that conform to the purport of the present invention.

In one embodiment of the present invention, the core 10 is formed so as to have a length (a dimension in the X direction) L2 of 1.0 to 2.5 mm, a width (a dimension in the Y direction) W2 of 0.5 to 2.0 mm, and a height (a dimension in the Z direction) H2 of 0.3 to 1.0 mm. In one embodiment of the present invention, the core 10 is formed so that a ratio (H2/L2) of the dimension H2 in a height direction thereof to the dimension L2 in a length direction thereof is 0.2 to 0.5.

In one embodiment of the present invention, a cross section of the core 10 perpendicular to the axis A of the winding core 11 is set to have a length of 1.4 mm in the X direction and a thickness of 0.4 mm in the Z direction.

In one embodiment of the present invention, a dimension (a dimension in the Y direction) W4 of each of the flange 12*a* and the flange 12*b* of the core 10 in a direction parallel to the axis A of the winding core 11 is set to 0.15 mm.

In one embodiment of the present invention, the flange 12*a* and the flange 12*b* are each configured so that the thickness (the height) H2 in the Z-axis direction is thicker than the thickness W4 in the direction parallel to the axis A of the winding core A.

The above-mentioned dimensions of the various portions of the core 10 are mere examples, and a drum core used in a coil component to which the present invention is applicable can have any dimensions that conform to the purport of the present invention.

Next, with reference to FIGS. 7A to 7F and FIGS. 8A to 8F, a description is given of a method for manufacturing the coil component 1 according to one embodiment of the present invention. FIGS. 7A to 7F and FIGS. 8A to 8F are schematic views explaining the method for manufacturing the coil component 1. FIGS. 7A to 7F schematically show views of the coil component 1 being manufactured as seen from a cross section cut along a plane passing through a line II-II, and FIGS. 8A to 8F schematically show views of the coil component 1 being manufactured as seen from a right side surface.

Figure 7A:
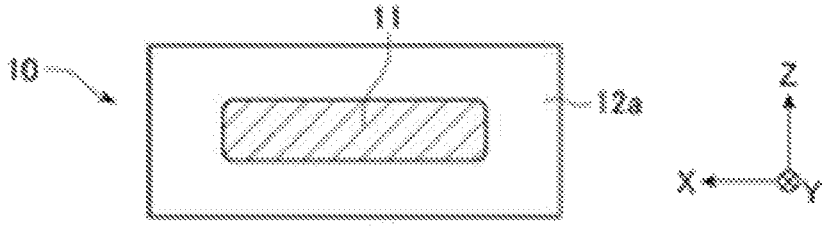
FIGS. 7A to 7F schematically show a method for manufacturing the coil component according to one embodiment.
Figure 8A:
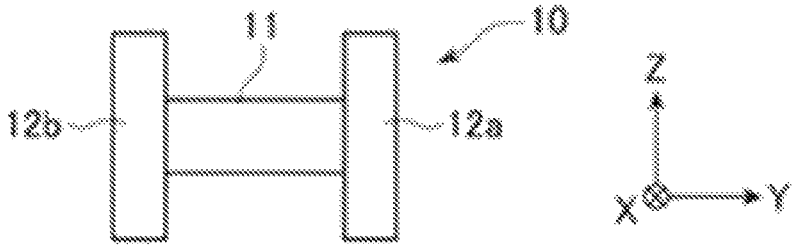
FIGS. 8A to 8F schematically show a method for manufacturing the coil component according to one embodiment.

First, the core 10 is prepared as shown in FIG. 7A and FIG. 8A. The core 10 is, for example, a resin-cured core. The resin-cured core 10 is produced by mixing the above-mentioned soft magnetic metal particles with a thermosetting resin to form a mixture and thermally curing the mixture. The core 10 may be a pressed powder core. The pressed powder core is produced by mixing the above-mentioned soft magnetic metal particles with a binder to form a granulated substance, press-molding the granulated substance by use of a molding die into a pressed powder body, and sintering the pressed powder body. A molded body thus obtained after the sintering or curing is subjected to cutting as required.

Next, dipping (immersion) is performed to make a silver paste adhere to a lower portion of the flange 12*a*, followed by drying of the silver paste, so that a first base electrode (not shown) is formed at an end portion of the flange 12*a* near the side surface 10*a* of the core 10 and a second base electrode (not shown) is formed at an end portion of the flange 12*a* near the side surface 10*b* of the core 10. In the flange 12*a*, the first base electrode and the second base electrode are provided so as to be spaced from each other by a predetermined distance in the X direction of the coil component 1. The base electrodes can be formed by, in addition to dipping, various known techniques such as brush coating, transfer, printing, a thin film process, metal plate pasting, and metal tape pasting.

Figure 7B:
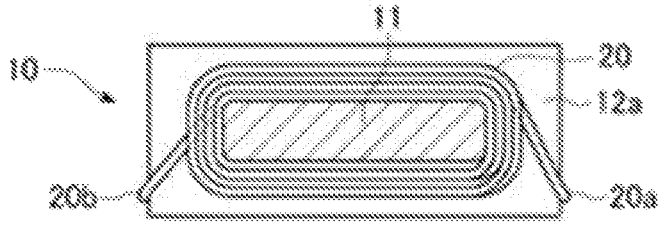
Figure 8B:
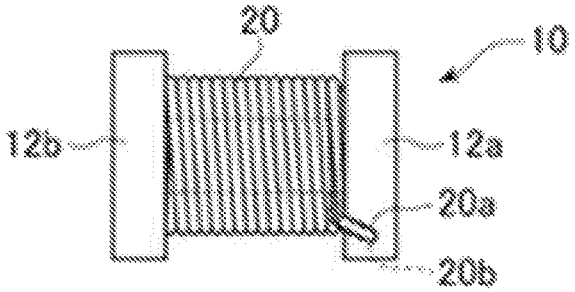

Next, as shown in FIG. 7B and FIG. 8B, the winding wire 20 is wound a predetermined number of turns on the winding core 11. The one end portion 20*a* of the winding wire 20 is bonded to the first base electrode by thermal compression, and the other end portion 20*b* of the winding wire 20 is bonded to the second base electrode by thermal compression. In addition to thermal compression bonding, various known techniques can be used to secure the winding wire 20 to the base electrodes. For example, the winding wire 20 can be secured to a corresponding one of the base electrodes by, for example, metal brazing, bonding with a heat resistant adhesive, sandwiching using a metal plate, or a combination thereof.

Figure 7C:
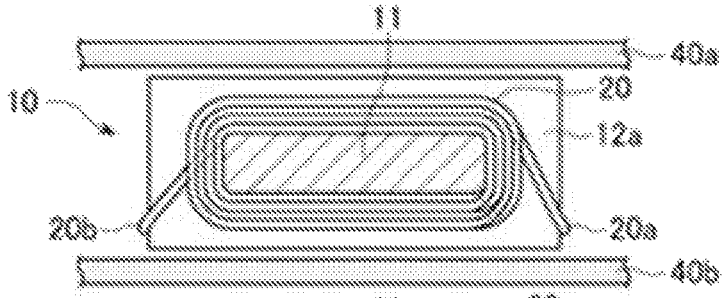
Figure 8C:
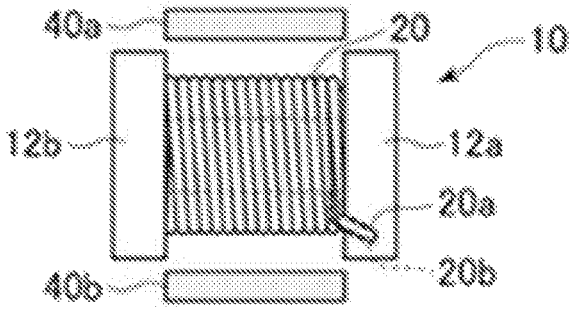

Next, a resin sheet 40*a* and a resin sheet 40*b* are prepared as shown in FIG. 7C and FIG. 8C. The resin sheet 40*a* and the resin sheet 40*b* are formed in the following manner. First, a thermosetting resin is kneaded with flat-shaped magnetic particles to obtain a kneaded composition. Next, the kneaded composition is applied on a substrate to obtain a sheet member having a thickness that is two or more times as large as a height of the core 10. Next, the sheet member is rolled while heat of about 120° C. is applied thereto. The sheet member after being rolled is set to have a thickness about half the thickness of the sheet member before being rolled. By this rolling process, a content ratio of the magnetic particles in the sheet member (a ratio of the magnetic particles to the resin) can be adjusted to a desired ratio. The sheet member after being rolled is cut so as to have a width substantially equal to a distance between the flange 12*a* and the flange 12*b*, and thus the elongated resin sheet 40*a* and the elongated resin sheet 40*b* are obtained.

Figure 7D:
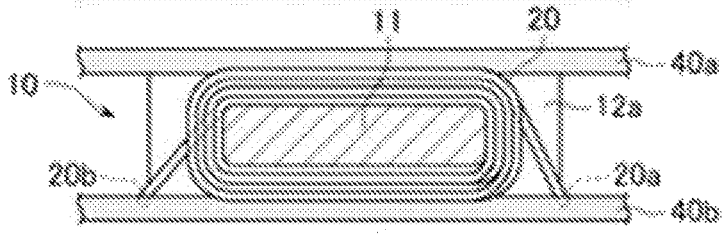
Figure 8D:
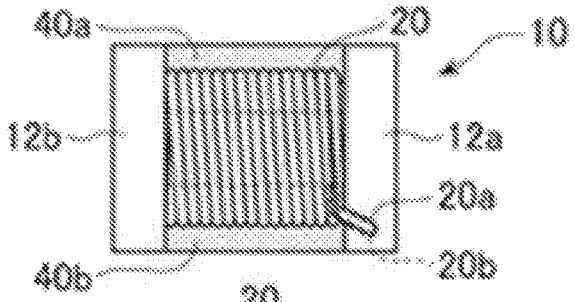

Next, as shown in FIG. 7D and FIG. 8D, the resin sheet 40*a* is inserted between the flange 12*a* and the flange 12*b* from near the top surface 10*c* of the core 10 and, similarly, the resin sheet 40*b* is inserted between the flange 12*a* and the flange 12*b* from near the bottom surface 10*d* of the core 10.

Figure 7E:
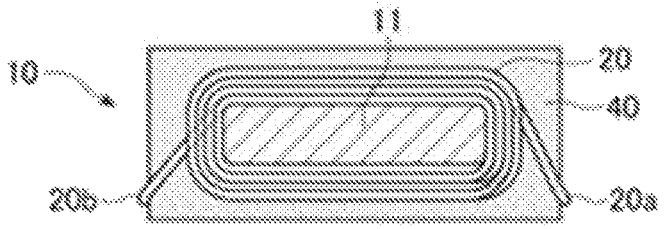
Figure 8E:
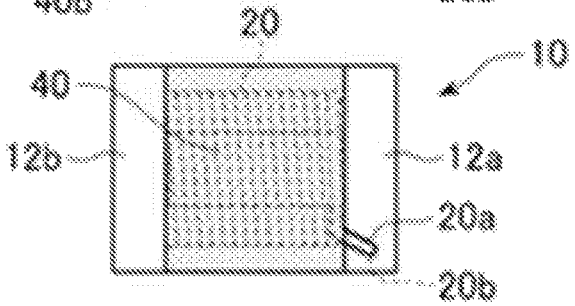

Next, as shown in FIG. 7E and FIG. 8E, the resin sheet 40*a* and the resin sheet 40*b* inserted between the flange 12*a* and the flange 12*b* are wound around the winding core 11 so as to cover the winding wire 20, and thus the sheathing body 40 is formed. That is, the resin sheet 40*a* and the resin sheet 40*b* wound between the flange 12*a* and the flange 12*b* around the winding core 11 so as to cover the winding wire 20 constitute the sheathing body 40. The resin sheet 40*a* and the resin sheet 40*b* are wound so that the end portion 20*a* and the end portion 20*b* of the winding wire 20 are exposed from the sheathing body 40.

Figure 7F:
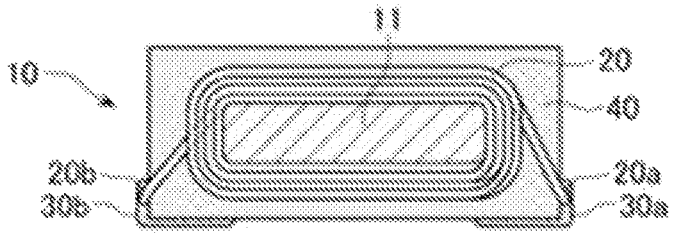
Figure 8F:
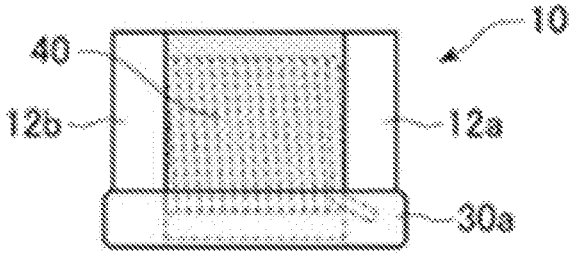

Next, as shown in FIG. 7F and FIG. 8F, in the core 10, at an end portion thereof in the width direction (the X direction) near the end surface 10*a*, a silver paste is applied to the bottom surface 10*d* and a region of the end surface 10*a* extending up to a predetermined height, and thus the external electrode 30*a* is formed. Similarly, in the core 10, also at an end portion thereof in the width direction (the X direction) near the end surface 10*b*, a silver paste is applied to the bottom surface 10*d* and a region of the end surface 10*b* extending up to a predetermined height, and thus the external electrode 30*b* is formed. The external electrode 30*a* is formed so as to be electrically connected to the end portion 20*a* of the winding wire 20, and the external electrode 30*b* is formed so as to be electrically connected to the end portion 20*b* of the winding wire 20.

The flange 12*a* and the flange 12*b* or the sheathing body 40 are/is partly polished as required. In the above-described manner, the coil component 1 is produced.

In the above-described manufacturing process of the coil component 1, the resin sheet 40*a* and the resin sheet 40*b* are cut into a desired size as appropriate. For example, in a case where, in the process shown in FIG. 7E and FIG. 8E, the resin sheet 40*a* or the resin sheet 40*b* is excessively long in the X-axis direction, an end portion thereof in the X-axis direction is cut off.

Next, a description is given of inductor characteristics of the coil component 1 in one embodiment. For a simulation of inductor characteristics, five evaluation models (Evaluation Model #0 to Evaluation Model #4) were formed. Evaluation Model #0 to Evaluation Model #4 were each a model of a transversely mounted coil component having a length (a dimension in an X direction) of 2.0 mm, a width (a dimension in a Y direction) of 1.6 mm, a height (a dimension in a Z direction) of 1.0 mm, and a designed inductance value of 0.5 μH. Evaluation Model #0 to Evaluation Model #4 each had a core corresponding to the core 10, a covered copper wire corresponding to the winding wire 20, a sheathing body corresponding to the sheathing body 40, and a pair of external electrodes corresponding to the first external electrode 30*a* and the second external electrode 30*b*. Evaluation Model #1 to Evaluation Model #4 were working examples of the coil component 1 according to one embodiment, and Evaluation Model #0 was a comparative example. Table 1 below shows, with respect to each of these models, a number of turns of the winding wire and respective relative magnetic permeabilities of the core and the sheathing body.

TABLE 1

| | Relative Magnetic Permeability of Core | Relative Magnetic Permeability of Sheathing Body | Number of Turns of Winding Wire |
|---|---|---|---|
| Evaluation Model #0 | 20 | 25 | 8.5 |
| Evaluation Model #1 | 30 | 25 | 8.5 |
| Evaluation Model #2 | 40 | 25 | 7.5 |
| Evaluation Model #3 | 50 | 25 | 6.5 |
| Evaluation Model #4 | 60 | 25 | 6.5 |

For comparison with inductor characteristics of these evaluation models, there were formed evaluation models of an integrally molded coil component having an integrally molded magnetic body with a winding wire embedded therein (Integrally Molded Model #1 to Integrally Molded Model #4). Integrally Molded Model #1 to Integrally Molded Model #4 were each a model of a transversely mounted coil component having a length (a dimension in an X direction) of 2.0 mm, a width (a dimension in a Y direction) of 1.6 mm, a height (a dimension in a Z direction) of 1.0 mm, and a designed inductance value of 0.5 μH. Table 2 below shows, with respect to each of these models, a number of turns of the winding wire and a relative magnetic permeability of the magnetic body on which the winding wire is wound. Since these integrally molded models are models of the integrally molded coil component having the integrally molded magnetic body with the winding wire embedded therein, a relative magnetic permeability of a portion thereof corresponding to a core is equal to that of a portion thereof corresponding to a sheathing body.

TABLE 2

| | Relative Magnetic Permeability of Magnetic Body | Number of Turns of Winding Wire |
|---|---|---|
| Integrally Molded Model #1 | 30 | 8.5 |
| Integrally Molded Model #2 | 40 | 7.5 |
| Integrally Molded Model #3 | 50 | 6.5 |
| Integrally Molded Model #4 | 60 | 5.5 |

Figure 9:
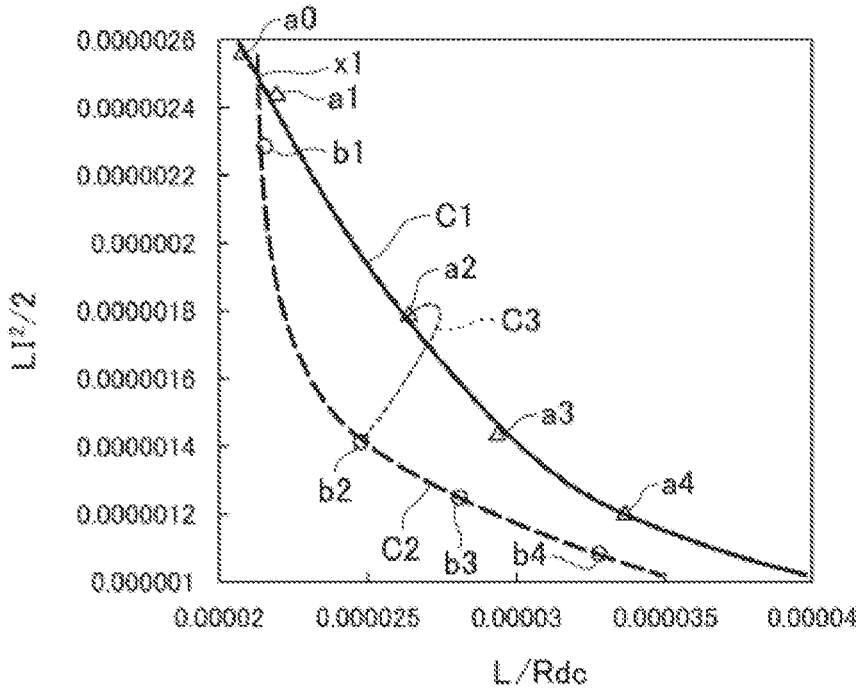
FIG. 9 is a graph showing results of simulating inductor characteristics of models of the coil component.

With respect to each of Evaluation Model #0 to Evaluation Model #4 and Integrally Molded Model #1 to Integrally Molded Model #4 formed as described above, LI2/2 and L/Rdc were calculated from a simulation. FIG. 9 shows respective values of LI2/2 and L/Rdc calculated with respect to each of these models. The inventors of the present invention took note of some characteristics among inductor characteristics of a coil component, which were represented by LI2/2 and L/Rdc, respectively. Here, L indicates an inductance of the coil component, I indicates a current flowing through a winding wire, and Rdc indicates a direct current resistance of the winding wire. Since LI2/2 represents energy stored in the coil component, herein, characteristics represented by LI2/2 may be referred to as energy characteristics. Since L/Rdc represents a Q value per unit frequency, herein, characteristics represented by L/Rdc may be referred to as loss characteristics.

FIG. 9 is a graph showing results of simulating inductor characteristics of the plurality of evaluation models of the coil component 1. In FIG. 9, a horizontal axis indicates L/Rdc, and a vertical axis indicates LI2/2. In FIG. 9, a0 to a4 are plotted to indicate the respective values calculated with respect to Evaluation Model #0 to Evaluation Model #4 in the above-mentioned simulation, and C1 is an approximate curve based on a0 to a4. Further, b1 to b4 are plotted to indicate the respective values calculated with respect to Integrally Molded Model #1 to Integrally Molded Model #4 in the above-mentioned simulation, and C2 is an approximate curve based on b1 to b4. In the graph of FIG. 9, as shown by a plotted position of each modeled coil component, the loss characteristics thereof become higher (that is, a loss of each modeled coil component becomes lower) toward a positive direction of the horizontal axis, and the energy characteristics thereof become higher toward a positive direction of the vertical axis.

As shown, the approximate curve C1 and the approximate curve C2 intersect with each other at an intersection X1. On the approximate curve C2, the intersection X1 corresponds to a position at which a relative magnetic permeability of 25 or approximately 25 is obtained. Based on a0 to a4 in the figure, it can be understood that, when a relative magnetic permeability of the core of each of Evaluation Model #0 to Evaluation Model #4 becomes larger, respective measurement values of LI2/2 and L/Rdc thereof shift to a lower right direction along the approximate curve C1. Furthermore, based on b1 to b4, it can be understood that, when a relative magnetic permeability of the magnetic body of each of Integrally Molded Model #1 to Integrally Molded Model #4 becomes larger, respective measurement values of LI2/2 and L/Rdc thereof shift to a lower right direction along the approximate curve C2. It can also be understood that, in an area on a positive side with respect to the intersection X1 in a horizontal axis direction, the approximate curve C2 is on a left side with respect to the approximate curve C1, and in an area on a negative side with respect to the intersection X1 in a vertical axis direction, the approximate curve C2 is on a lower side with respect to the approximate curve C1.

In the coil component 1, the larger the respective relative magnetic permeabilities of the core 10 and the sheathing body 40 are, the larger the value of L/Rdc is, and thus when the relative magnetic permeability of the core 10 is fixed, as the relative magnetic permeability of the sheathing body 40 increases, a plotted position indicating respective measurement values of LI2/2 and L/Rdc shifts to a right side (a positive direction side of the horizontal axis) in the graph. For example, in a coil component whose core has a relative magnetic permeability of 40 and whose sheathing body has a relative magnetic permeability of 25, when the relative magnetic permeability of the sheathing body is increased from 25 to 40 while the relative magnetic permeability of the core is maintained at 40, a plotted position indicating respective measurement values of LI2/2 and L/Rdc shifts from a2 approximately along a curve C3. The curve C3 is a curve extending between a2 and b2. In the coil component 1, the relative magnetic permeability of the core 10 is larger than the relative magnetic permeability of the sheathing body 40, so that in no case does the curve C3 extend below the curve C2. An intersection of the curve C2 and the curve C3 falls on a position at which the relative magnetic permeability of the core and the relative magnetic permeability of the sheathing body are both 40 (namely, a position of b2). Although a specific shape of the curve C3 varies depending on various factors, regardless of such variation factors, the curve C3 extends from a2 toward the positive direction of the horizontal axis to a position at which it runs into the curve C2 (the position of b2). While the foregoing has described the plotted position in a case where the core has a fixed relative magnetic permeability of 40, the above-described principles similarly apply also to a case where the relative magnetic permeability of the core varies. For example, in a case where the core has a relative magnetic permeability of 50, a plotted position indicating measurement values thereof lies on a curve (a curve corresponding to the curve C3) extending from a3 in the positive direction of the horizontal direction to a position at which it runs into the curve C2.

Figure 10:
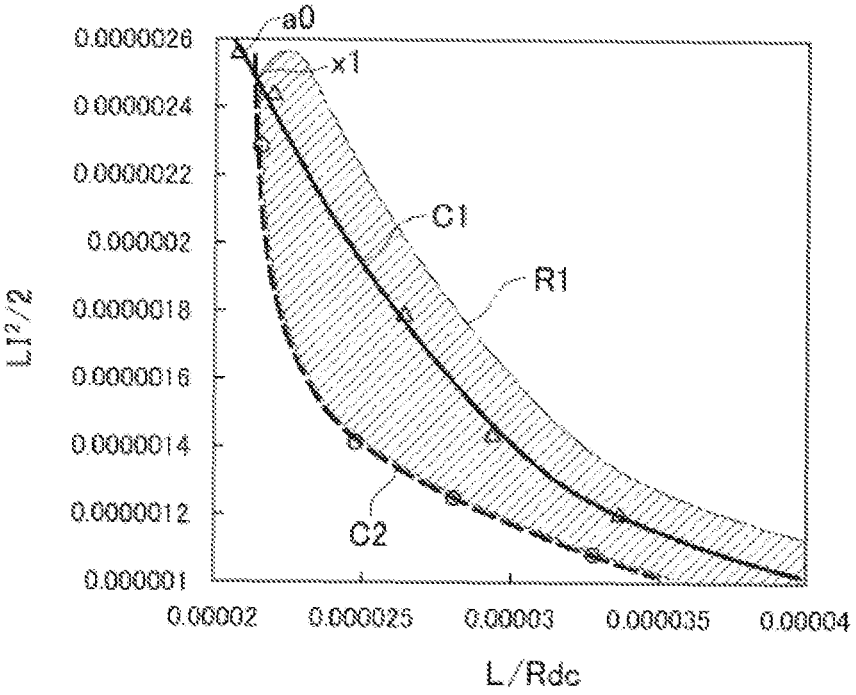
FIG. 10 is a schematic view for explaining energy characteristics and loss characteristics of the coil component according to one embodiment.

As described above, in the coil component 1, the relative magnetic permeability of the sheathing body is larger than 25, and the relative magnetic permeability of the core is larger than the relative magnetic permeability of the sheathing body, and thus respective measurement values of LI2/2 and L/Rdc of the coil component 1 are positioned on a curve (a curve corresponding to the curve C3) extending in the positive horizontal axis direction from a position (for example, a2) on the curve C1 on a positive side with respect to the intersection X1 in the horizontal axis direction to a position at which it runs into the curve C2. Accordingly, respective measurement values of LI2/2 and L/Rdc of the coil component 1 can be distributed approximately inside a hatched area R1 in FIG. 10. The area R1 is positioned on the upper right with respect to the curve C2 in the graph.

As thus described, it was confirmed that, compared with the integrally molded coil component, the coil component whose sheathing body had a relative magnetic permeability smaller than that of the core, the relative magnetic permeability of the sheathing body being 25 or more, had excellent energy characteristics and loss characteristics.

The dimensions, materials, and arrangements of the various constituent elements described herein are not limited to those explicitly described in the embodiments, and the various constituent elements can be modified to have any dimensions, materials, and arrangements within the scope of the present invention. Furthermore, constituent elements not explicitly described herein can also be added to the embodiments described, and it is also possible to omit some of the constituent elements described in the embodiments.

For example, it is also possible to use, as the coil component 1, a four-terminal coil component having four external electrodes. In the four-terminal coil component, in place of the winding wire 20, two winding wires electrically insulated from each other are wound around a wiring core 11. Both end portions of the two winding wires are each connected to an appropriate one of the four external electrodes. The coil component having the four terminals can be used as a common mode choke coil, a transformer, or any other coil component required to have a high coupling coefficient.

In a case where the coil component 1 is used as a transformer having an intermediate terminal, a configuration may be adopted in which an intermediate flange is provided between a flange 12*a* and a flange 12*b*, and an external electrode acting as the intermediate terminal is provided on the intermediate flange.

In a case where the coil component 1 is used as a common mode choke coil having winding wires for three systems, a configuration can be adopted in which an intermediate flange is provided between a flange 12*a* and a flange 12*b*, and an external electrode for one of the winding wires used for the third system is provided on the intermediate flange. For example, C-PHY developed by the MIPI Alliance stipulates that three signal lines per lane are used to differentially transmit a signal. The coil component 1 can be used as a common mode choke coil conforming to C-PHY.

In the coil component 1, the winding core 11 of the core 10 may be disposed so as to extend in a direction perpendicular to the mounting surface of the circuit board. In this case, the coil component 1 is longitudinally mounted on the circuit board.

What is claimed is:

1. A coil component, comprising:

a core containing a plurality of soft magnetic metal particles, the core including a winding core, a first flange, and a second flange, the first flange provided at one end portion of the winding core, a second flange provided at the other end of the winding core;

a winding wire wound on the core; and a sheathing body provided on the core so as to cover at least part of the winding wire, only a part of the first flange, and only a part of the second flange, the sheathing body having a relative magnetic permeability smaller than that of the core, wherein the sheathing body has a relative magnetic permeability of more than 30;

wherein the core has a relative magnetic permeability of 60 or less; and wherein the plurality of soft magnetic metal particles contained in the core is Fe—Si—Cr alloy; wherein the core extends along a coil axis in parallel to a mounting surface of a circuit board to which the coil component is adapted to be mounted, wherein the coil component has a widthwise dimension along the coil axis and a lengthwise dimension orthogonal to the coil axis and the widthwise dimension, and wherein the widthwise dimension is smaller than the lengthwise dimension.

2. The coil component according to claim 1, wherein the core has a relative magnetic permeability of 30 or more.

3. The coil component according to claim 1, wherein the sheathing body has a relative magnetic permeability of 50 or less.

4. The coil component according to claim 1, wherein the core contains a conjugate composed of adjacent ones of the plurality of soft magnetic metal particles, the adjacent ones being conjugated to each other.

5. The coil component according to claim 1, wherein the core contains a resin, and the plurality of soft magnetic metal particles are contained in the resin.

6. The coil component according to claim 5, wherein a content of the plurality of soft magnetic metal particles in the core is 50 wt % to 95 wt %.

7. The coil component according to claim 5, wherein the plurality of soft magnetic metal particles include Fe particles, and a content of the Fe particles in the core is 50 wt % to 95 wt %.

8. The coil component according to claim 5, wherein the plurality of soft magnetic metal particles include Fe particles, and a content of the Fe particles in the core is 55 wt % to 85 wt %.

9. The coil component according to claim 1, wherein the sheathing body is made of a composite resin material containing a plurality of magnetic particles.

10. The coil component according to claim 1, further comprising:

a first external electrode provided at the first flange, the first external electrode electrically connected to the winding wire, and a second external electrode provided at the second flange, the second external electrode electrically connected to the winding wire.

11. The coil component according to claim 1, further comprising a first external electrode provided at the first flange and the second flange, the first external electrode electrically connected to the winding wire; and a second external electrode provided at the first flange and the second flange, the second external electrode electrically connected to the winding wire, wherein the first external electrode and the second external electrode extend between the first flange and the second flange along the widthwise dimension.

12. The coil component according to claim 1, wherein the widthwise dimension is 0.5-2.1 mm, and the lengthwise dimension is 1-2.6 mm.

13. The coil component according to claim 1, wherein the sheathing body is formed of resin sheet having a width equal to a distance between the first flange and the second flange, the sheathing body disposed on the core between the first flange and the second flange so as to cover at least part of the winding wire.

14. The component according to claim 13, wherein an outer surface of the sheathing body is flush with an outer surface of the first and second flanges, and wherein an electrode is disposed on the outer surface of each of the first and second flanges.

* * * * *